US006386831B1

(12) United States Patent
Stahl et al.

(10) Patent No.: US 6,386,831 B1
(45) Date of Patent: May 14, 2002

(54) FAN WHEEL

(75) Inventors: Hermann Stahl, Steinheim; Erwin Wolf, Weissach, both of (DE)

(73) Assignee: Hermann Stahl GmbH, Grossbottwar (DE)

( * ) Notice: Subject to any disclaimer, the term of this patent is extended or adjusted under 35 U.S.C. 154(b) by 0 days.

(21) Appl. No.: 09/554,903

(22) PCT Filed: Nov. 21, 1998

(86) PCT No.: PCT/EP98/07507

§ 371 Date: May 19, 2000

§ 102(e) Date: May 19, 2000

(87) PCT Pub. No.: WO99/27258

PCT Pub. Date: Jun. 3, 1999

(30) Foreign Application Priority Data

Nov. 21, 1997 (DE) ..... 197 51 729

(51) Int. Cl.[7] ..... F04D 29/38

(52) U.S. Cl. ..... 416/186 R; 416/186 A; 416/214 R; 416/212 R; 29/889.21

(58) Field of Search ..... 416/186 R, 186 A, 416/212 R, 213 A, 214 R, 223 B, DIG. 3; 29/889.21, 889.22, 889.23, 524.1, 525

(56) References Cited

U.S. PATENT DOCUMENTS

| | | | | |
|---|---|---|---|---|
| 3,116,696 A | * | 1/1964 | Deters | 416/186 A |
| 4,174,559 A | * | 11/1979 | Persik et al. | 29/524.1 |
| 4,817,856 A | * | 4/1989 | Koistinen et al. | 29/889.4 |
| 6,146,094 A | * | 11/2000 | Obana et al. | 416/186 R |

FOREIGN PATENT DOCUMENTS

| | | |
|---|---|---|
| DE | 800 238 | 10/1950 |
| DE | 32 47 453 | 12/1983 |
| DE | 85 18 403 | 9/1985 |
| FR | 1 465 334 | 1/1967 |
| GB | 789 674 | 1/1958 |

OTHER PUBLICATIONS

PCT Search Report.

* cited by examiner

*Primary Examiner*—Edward K. Look
*Assistant Examiner*—Richard Woo
(74) *Attorney, Agent, or Firm*—Gudrun E. Huckett

(57) ABSTRACT

The invention relates to a fan wheel for a turbo charger. The fan wheel (1) is comprised of a base body with a central axis of rotation (5) wherein the base body is assembled of two cover discs (2, 3) positioned approximately congruently opposite one another, between whose end faces (12, 13) facing one another fan blades (6) are arranged. The fan blades (6) are formed as monolithic parts on at least one of the cover discs (2, 3) and have an axial contact surface (30) against which an oppositely positioned axial contact surface (31) of the other cover disc (2,3) rests. Fastening means are provided in the area of the contact surfaces (8, 9) for non-detachably connecting the cover discs (2, 3) to one another. In order to produce the fan wheel (1) without balancing, the cover discs (2, 3) are embossed from a material that can be embossed and the fan blades (6) are embossed axially out of the material of a cover disc (2, 3), wherein the edge (22*a*, 22*b*) between the plane of the cover disc (2,3) and the sidewall (19*a*, 19*b*) of a fan blade (6) positioned substantially at a right angle to the plane of the cover disc (2, 3) as well as the edge (21*a*, 21*b*) between the sidewall (19*a*, 19*b*) of the contact surface (30, 31) are rounded with a radius (R1, R2) of approximately 0.5 to 2 mm.

18 Claims, 5 Drawing Sheets

FAN WHEEL

BACKGROUND OF THE INVENTION

1. Field of the Invention

The invention relates to a fan wheel for conveying an air mass, especially for a turbo charger, ventilator or a similar device, comprised of a base body with a central axis of rotation, wherein the base body is comprised of two cover discs positioned approximately congruently opposite one another, between whose inner end faces facing one another fan blades are arranged which are formed as monolithic parts at least on one of the cover discs and have an axial contact surface against which an oppositely positioned axial contact surface of the other cover disc rests, and with fastening means in the area of the contact surfaces for non-detachably connecting the cover discs to one another.

2. Description of the Related Art

Such a known fan wheel is disclosed in DE 85 18 403. It is comprised of two cover discs approximately parallel to one another between which the fan blades are arranged. At one of the cover discs grooves are formed which rest against the other cover disc and thus form the fan blades. For connecting the cover discs, they are glued, welded or connected by separate rivets to one another in the area of the contact surfaces. The thus constructed fan wheels must be balanced before being operated because unbalance will usually occur due to tolerances, material concentrations etc. and must be equalized because of the high operational rpm of the turbo charger of, for example, 20,000 rpm. The manufacture of such fan wheels therefore requires many parts, is labor-intensive, and expensive.

The invention has the object to develop a fan wheel of the aforementioned kind such that it can be produced in a few simple manufacturing steps and can be assembled to a ready-to-use state without requiring balancing.

SUMMARY OF THE INVENTION

This object is solved according to the invention in that the cover discs are comprised of a material that can be embossed and in that the fan blades are embossed axially out of the material of a cover disc, wherein the edge between the plane of the cover disc and the sidewall of a fan blade positioned substantially at a right angle to the plane of the cover disc as well as the edge between the sidewall and the contact surface are rounded with a radius of approximately 0.5 to 2 mm.

The use of a material that can be embossed such as, for example, sheet metal that can be deep-drawn, i.e., sheet steel, stainless sheet steel, sheet aluminum etc., allows to emboss during the manufacture of the cover discs simultaneously the fan blades over a portion of or over their entire axial height. With this non-cutting forming and embossing, the material quantity is not changed so that a final balancing is no longer needed. Due to the monolithic embodiment of the fan blades with the cover disc, only a few fastening points are required. The fan wheel is comprised of only two axially joined parts wherein one axial contact surface of one of the cover discs rests fixedly against the axial contact surface of the other cover disc. All edges that are exposed to the airflow are rounded so that a high conveying efficiency is provided with minimal noise development.

Expediently, the cover discs are connected positive-lockingly to one another in the area of the contact surfaces. Advantageously, connecting locations are provided only in the area of the contact surfaces.

In an advantageous embodiment of the invention, fixation openings can be provided at one of the contact surfaces of one cover disc. Fixation noses, for example, by drawing or impact extrusion, are formed at the oppositely positioned contact surface of the second cover disc. When aligning the cover discs relative to one another, the fixation noses engage the oppositely positioned fixation openings which are advantageously provided with a countersunk portion at the rivet head side so that the position-exact correlation of the two parts is ensured. Since the fixation noses and fixation openings are provided exclusively on the contact surfaces of the fan blades, the correct rotational position of the cover discs relative to one another is determined at the same time so that all fan blades, uniformly distributed in the circumferential direction of one cover disc, contact the correlated contact surfaces of the other cover disc. Expediently, the fixation noses are formed by impact extrusion resulting in rivet bolts with which the cover discs are connected to one another in a non-detachable manner in the area of the contact surfaces. Since with this connecting technique no material is added, the otherwise required balancing measures are no longer needed.

Expediently, the fan blades are formed by the walls of an embossed depression, wherein the depression at the same time provides strengthening of the cover disc.

The depressions are advantageously closed off at their ends and extend in the radial direction only over a portion of the radius of the cover disc. The radial ends of the depressions, i.e., of the fan blades, have a rounded end face.

Advantageously, one cover disc is provided, especially at the inner side facing the airflow, with a waffle-like or scale-like embossment. This can provide an improved flow of the airflow conveyed by the fan wheel. The waffle-like embossment moreover avoids stress in the cover disc so that a planar, distortion-free shape of the cover disc is ensured. Even at high rpm no unbalance will be observed. The scale-like embossment also eliminates the need for a planing action of the cover disc subsequent to embossing the depressions, which form the fan blades, and, moreover, can provide flow-technological advantages and can dissipate heat that develops.

BRIEF DESCRIPTION OF THE DRAWING

Further features of the invention result from the further claims, the description, and the drawing, in which embodiments of the invention are represented which will be explained in the following in more detail. It is shown in:

DESCRIPTION OF THE PREFERRED EMBODIMENTS

Figure 1:
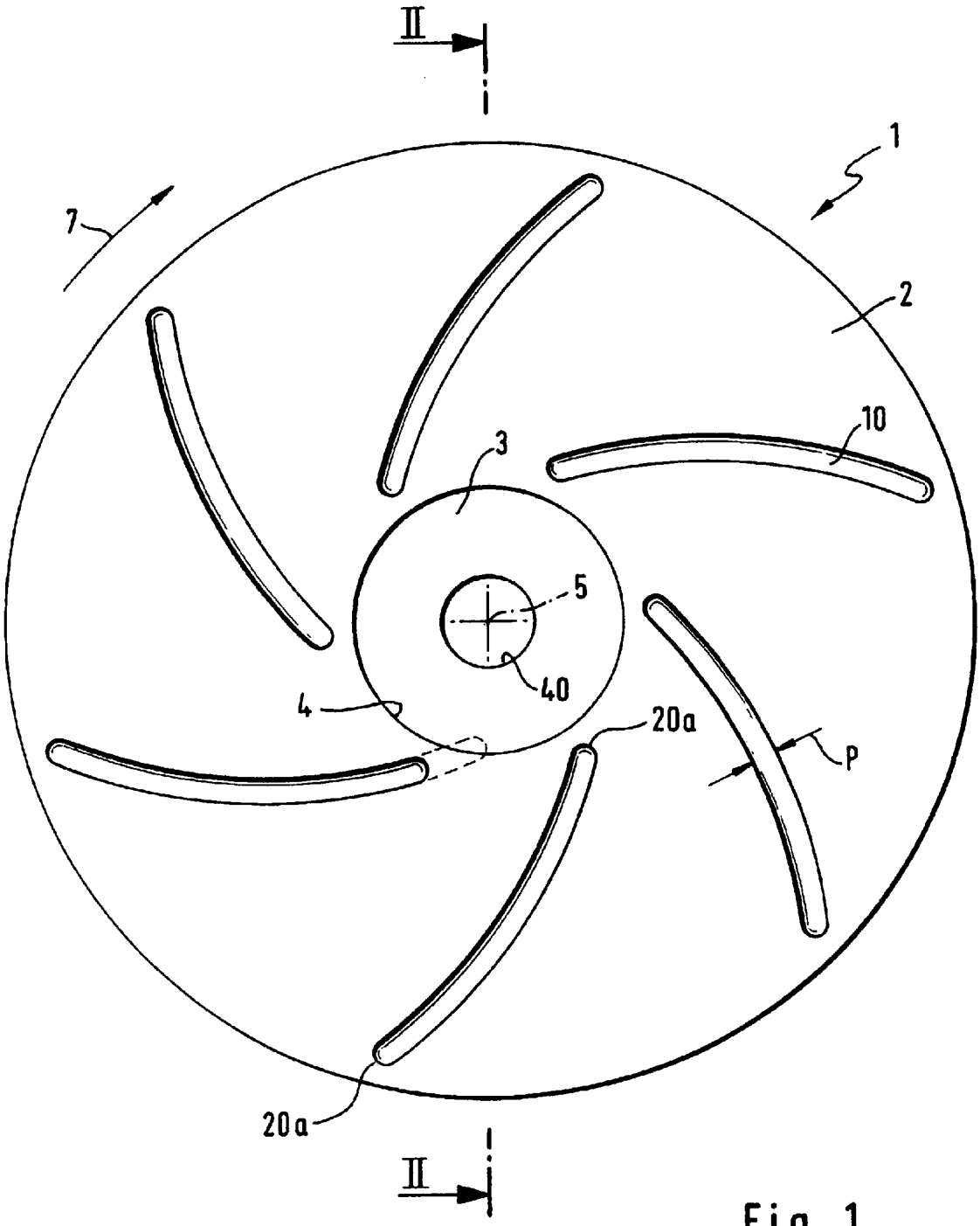
FIG. 1 a plan view onto a fan wheel according to the invention.

In FIG. 1 a plan view onto a fan wheel 1 for conveying an air mass is shown, as is used in particular in a turbo charger. The fan wheel according to the invention is also advantageously usable in other technological fields, for example, as a ventilator, a cooling air fan etc..

The fan wheel 1 is comprised essentially of two congruently positioned cover discs 2 and 3 which are parallel to one another in the shown embodiment and have a central opening 4 and 40, respectively, for connecting it, for example, to a hub. The central openings 4, 40 are positioned coaxially to the axis of rotation 5 of the base body or the fan wheel 1. The cover discs 2, 3 have advantageously the same material thickness; in the shown embodiment according to FIGS. 1 and 7, different material thickness (FIG. 2) is shown wherein the smaller opening 40 is provided in the cover disc 3 which is, for example, the thicker one. For attachment to the end of a shaft 41, the shaft 41 engages via the larger opening 4 the fan wheel 1 and rests with an annular shoulder 42 against the cover disc 3. A threaded portion 43 of the shaft 41 penetrates the opening 40 of the cover disc 3, and a fastening nut 44 is screwed onto the portion 43. The fan wheel 1 is thus fixedly secured on the shaft 41 so as to rotate with it.

Figure 2:
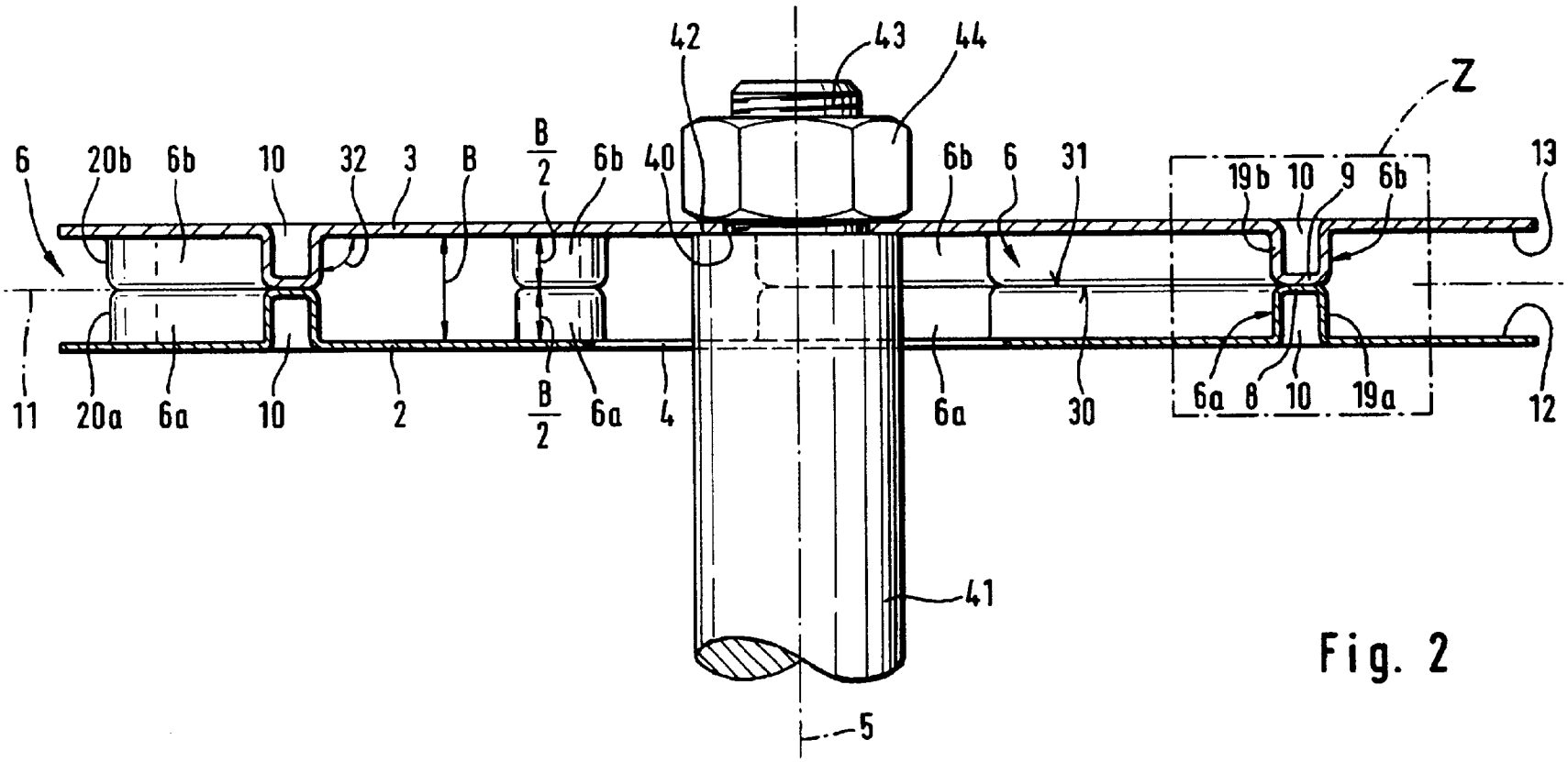
FIG. 2 a section along the line II—II of FIG. 1.

As can be seen in FIG. 2, fan blades 6 are provided between the facing end faces 12 and 13 of the cover discs 2 and 3. They can be slightly curved in the direction of rotation 7 (FIG. 1). The arrangement is such that, when the fan wheel 1 rotates in the direction of rotation 7, air is sucked in via the central opening 4 of one of the cover discs 2 and flows radially outwardly. The fan wheel thus has axial inflow and radial outflow.

As can be seen in FIG. 2, a fan wheel blade 6 is formed at least over a portion 6*a*, 6*b* of the height B, measured in the direction of the axis of rotation 5, as a monolithic part of the cover disc 2 or 3. In the embodiment according to FIG. 2, one half B/2 of the height B of the fan blade 6 is formed as a monolithic part of the cover disc 2 and the other half B/2 as a monolithic part of the cover disc 3. It may also be expedient to provide different widths of the parts 6*a*, 6*b* forming the fan blade 6.

In the shown embodiment the fan blades 6 are embossed depressions 10 formed axially out of the material of the cover discs 2, 3 wherein the cover discs 2, 3 are made of a material that can be embossed such as, for example, sheet metal, sheet steel, or stainless sheet steel that can be deep-drawn. Moreover, configurations of sheet aluminum or aluminum alloys can also be easily realized. As a function of the desired application, the material of the cover discs 2, 3 may also be a plastic material, optionally a carbon fiber reinforced plastic material. The depressions 10 are positioned in regard to their radial extension advantageously within the inner or outer diameter of the cover discs, wherein the ends of the depressions 10 are closed.

For a simple assembly it is expedient to configure the cover discs 2 and 3 approximately mirror-symmetrically and identically to one another relative to the plane of separation 11. As shown in FIG. 2, the depressions 10 embossed as monolithic parts of the cover discs 2 are comprised of a flat bottom 8, 9, serving as a contact surface 30, and connected by sidewalls 19*a*, 19*b* to the cover disc 2, 3. Accordingly, upon assembly of the fan wheel 1, the cover discs 2 and 3 can be easily axially joined wherein the bottom 8 of a fan blade of the cover disc 2 contacts the bottom 9 of a mirror-symmetrically embossed fan blade of the other cover disc 3. The bottoms 8, 9 have a width of 1 to 10 mm, preferably 2 to 5 mm.

Figure 3:
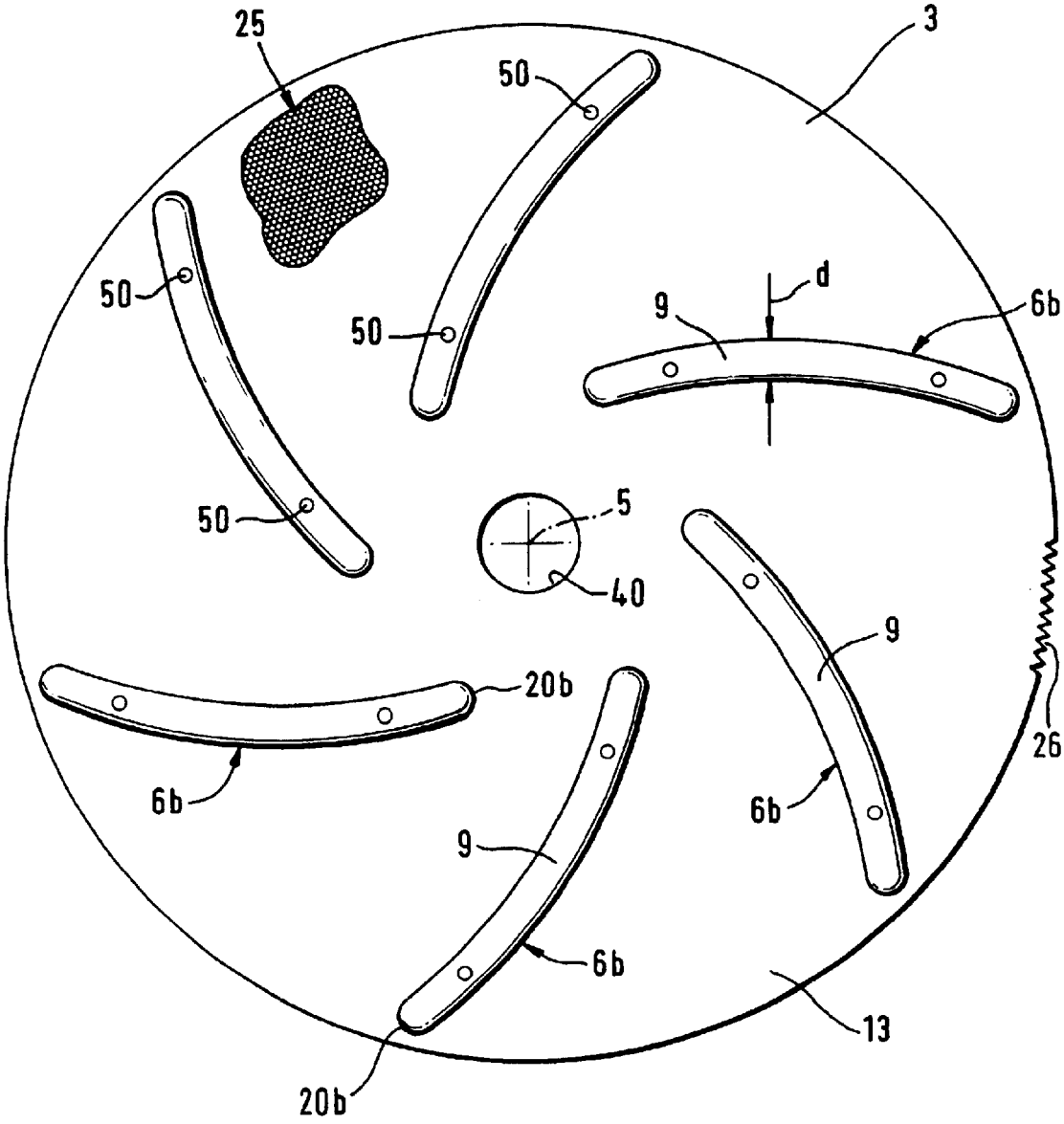
FIG. 3 a plan view onto a cover disc of the fan wheel with embossed parts of the fan blades.
Figure 4:
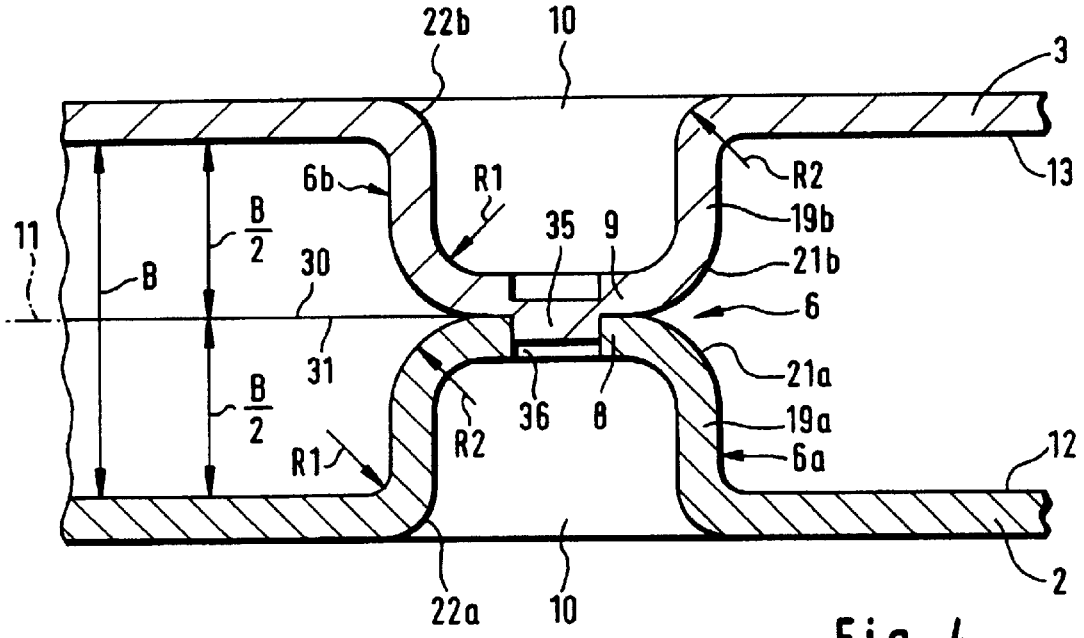
FIG. 4 on an enlarged scale the detail Z of FIG. 2 with fixation noses for positional alignment.
Figure 5:
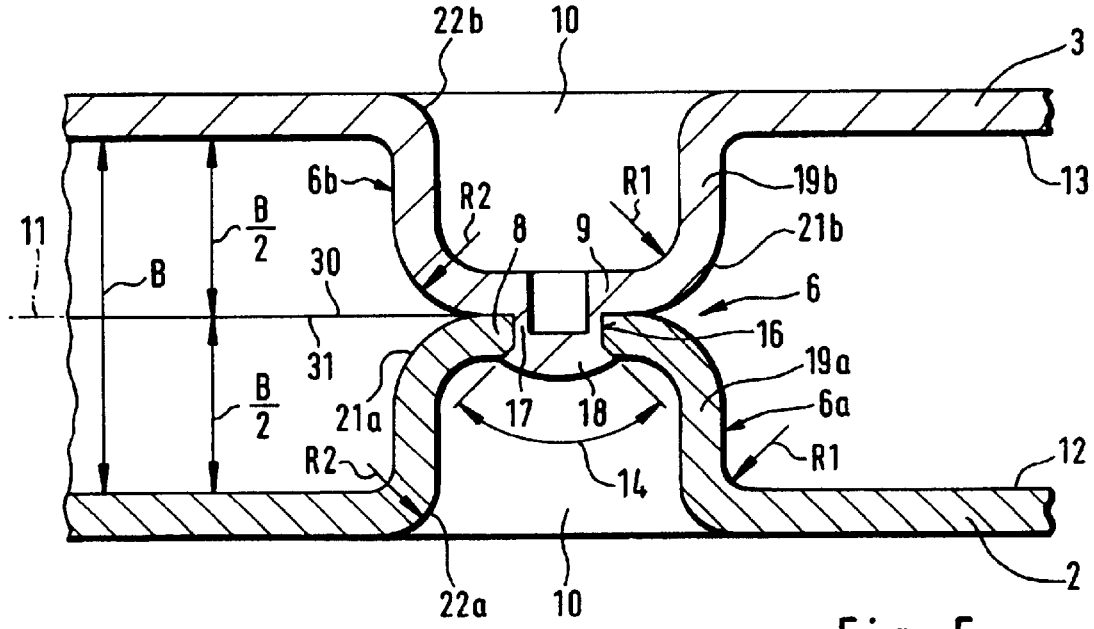
FIG. 5 on an enlarged scale the detail Z of FIG. 2 with fixation noses embodied as rivet bolts and a countersunk portion of the rivet bore on the rivet head side.

As is shown in FIGS. 4 and 5, the embossed depressions 10 of the fan blades are formed such that there are no edges which could impede the airflow. Accordingly, the sidewalls 19*a*, 19*b* are connected by a rounded edge 21*a*, 21*b* to the bottom 8, 9. Preferably, the inner radius R1 of the depression 10 is approximately 0.5 to 2.5 mm, preferably 0.5 mm, while the outer radius R2 of the edges 21*a*, 21*b* exposed to the airflow is approximately 0.5 to 2 mm, preferably 1 mm. In the same way, the edge 22*a*, 22*b* between the sidewall and the cover disc 2, 3 has an outer radius R2 of 0.5 to 2 mm, preferably 1 mm, and an inner radius R1 exposed to the airflow of 0.5 to 2 mm, preferably 0.5 mm. In this context it may be advantageous to round the edges 21*a*,21*b* to a greater extent than the edges 22*a*, 22*b*. The sidewalls 19*a* of the fan blades 6 embossed from the cover disc 2 have along their entire radial extension advantageously the same axial height B/2 wherein each sidewall is positioned approximately at a right angle 32 to the plane of the cover disc 2, 3 and approximately at a right angle to a plane positioned perpendicularly to the axis of rotation 5. The FIGS. 2 and 3 show that the radially outer ends of the fan blades 6 are comprised of adjacently positioned end faces 20*a*, 20*b* of the depressions 10 of the cover discs 2 and 3. Each end face 20*a*, 20*b* is rounded with a radius of 1 to 4 mm, preferably 1.5 mm.

It may be expedient to design the depressions 10, embossed from the cover discs 2 and 3 to form the fan blades, differently, for example, with different radial lengths, with different heights measured in the circumferential direction, or with increasing or decreasing width along the radial length. The contact surfaces 30, 31 formed on the bottoms 8,9 are positioned parallel to a plane of separation 11; the axis of rotation 5 is perpendicular to the plane of separation 11. The height of the embossed depressions 10 corresponds approximately to the height B/2 of the blade parts 6*a*, 6*b* of the fan blade 6 and is maximally 1 to 10 mm, preferably approximately 5 mm. The extension P (FIG. 1), measured in the circumferential direction, of a depression 10 corresponds approximately to the thickness d (FIG. 3), measured in the circumferential direction, of a fan blade 6.

The cover discs 2, 3 in the area of the contact surfaces 30 and 31 of the fan blades 6 are non-detachably fixedly connected to one another, so that the two cover discs 2, 3 with the monolithic embossed depressions 10 form a joined non-detachable component. In order to ensure a position-exact alignment of the cover discs 2 and 13 relative to one another, a fixation nose 35 (FIG. 4) is formed on one contact surface 30 which engages a corresponding fixation depression or fixation opening 36 in the other contact surface 31. In this congruently aligned position the cover discs 2, 3 are connected to one another in the area of the contact surfaces 30, 31.

In the embodiment according to FIG. 5 the fixation noses are formed as rivet bolts 17. At one of the contact surfaces 30 of the fan blade 6 a rivet bolt 17 is provided which engages a corresponding rivet opening 16 in the contact surface 31 of the other part and is deformed to a rivet head 18 for a non-detachable connection of the cover discs 2 and 3. Advantageously, the rivet opening 16 at the side facing the rivet head 18 is provided with a countersunk portion 14. Accordingly, the length of the rivet bolt 17 can be shortened so that its driving out of the material of the cover disc can be safely performed. This riveting action using own material is advantageous with respect to balancing criteria in the context of a simple manufacture.

Figure 6:
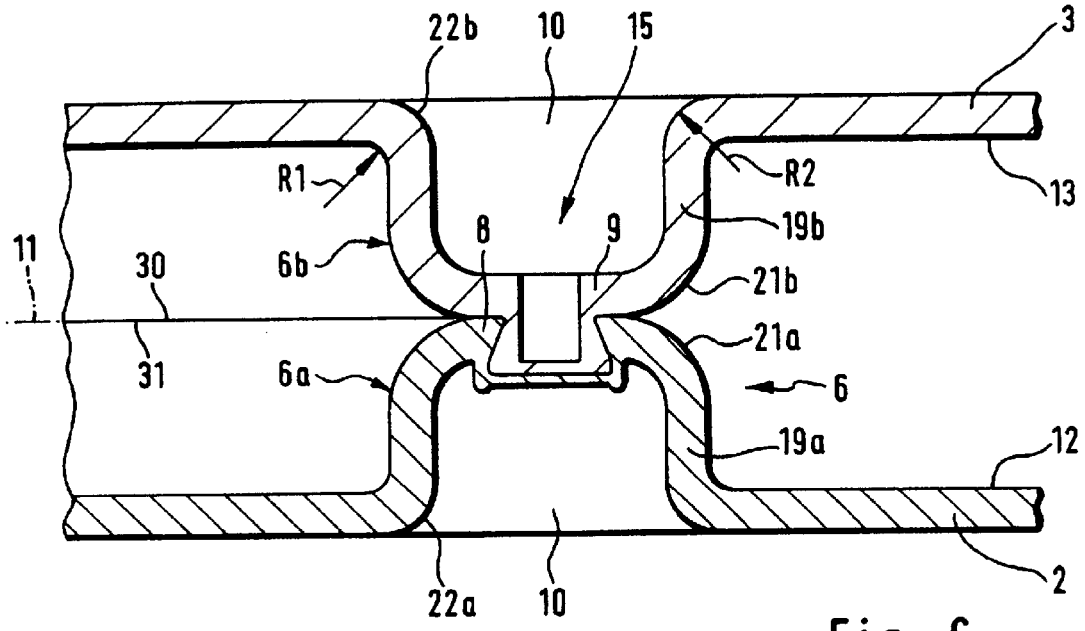
FIG. 6 an enlarged representation of the detail Z of FIG. 2 with cover discs connected positive-lockingly to one another by clinching.

As is shown in FIG. 6, the cover discs 2, 3 in the area of the contact surfaces 30, 31 of the fan blade 6 can also be non-detachably connected to one another by clinching and pressure joining which is also referred to as swaging. In this process, the material of the cover disc 3 is driven and deformed into the joining area 15 of the material of the cover discs 2.

Expediently, two fastening locations each are provided over the length of a fan blade 6—two swaging rivets or rivet bolts 17 each in the embodiment of the FIGS. 5 and 6—which are advantageously positioned with the same spacing to the ends of the fan blade 6, respectively, the bottom 9 of the parts 6*a*, 6*b* forming the fan blade on which they are supported. Accordingly, for uniformly distributed fan blades, for example, six, in the circumferential direction of the cover discs 2, 3, there are 12 positive-locking rivet connections 50 provided, as indicated in FIG. 3.

Figure 7:
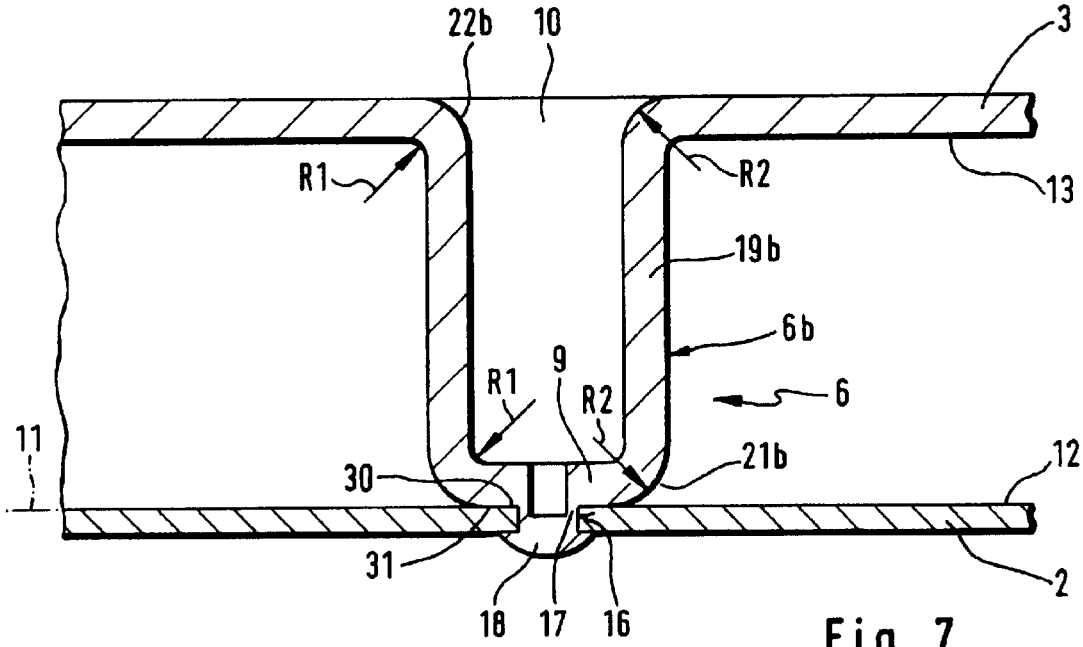
FIG. 7 an enlarged representation of the detail Z of FIG. 2 with cover discs of different thickness riveted to one another by their own material.

In the embodiment according to FIG. 7, the fan blade 6 is comprised of a single embossed depression 10 of the cover disc 2. This depression has a contact surface 30 which rests against a corresponding contact surface 31 on the cover disc 3. As illustrated in FIG. 7, a rivet bolt 17 formed on the contact surface 30 engages the rivet opening 16 in the cover disc 3 so that a positive-locking connection between the cover discs 2 and 3 is achieved. In the embodiment according to FIG. 7, the fan blade 6 is formed within the cover disc 3 having the greater material thickness. In this manner it can be ensured that the material required for the embossing action of forming the fan blade 6 is available.

The fan wheel 1 according to the invention is comprised of only two parts which can be easily joined in a mechanized fashion so that a high degree of mechanization of the manufacture can be achieved.

The fan wheel according to the invention can be used without any further balancing measures and exhibits only a minimal noise development which is favored by the rounded edges of the depressions formed by impact extrusion. For increasing the conveying efficiency with minimal noise development, it may be advantageous to roughen at least the inner end faces 12, 13 of the cover discs 2, 3. As shown in FIG. 3, the end face 13 can have a waffle-like or scale-like areal embossment 25. The embossment 25 also ensures that the cover disc is planar so that, despite embossing the depressions 10, a uniform planar shape is provided that can be used without further balancing measures at high rpm of, for example, 20,000 rpm. The embossment at the inner side of the cover disc also has flow-technological advantages. For a further noise reduction it may be advantageous to provide the outer radial edge of the cover discs 2, 3 with a toothing 26, as is illustrated in FIG. 2.

What is claimed is:

1. A fan wheel for conveying an air mass, said fan wheel comprising:

a base body having a central axis of rotation (5), wherein said base body is comprised of a two cover discs (2, 3) positioned congruently opposite one another;

said two cover discs (2, 3) having inner end faces (12, 13) facing one another;

fan blades (6) positioned between said inner end faces (12, 13), wherein said fan blades (6) are axially embossed out of a plane of at least one of said two cover discs (2, 3);

each one of said fan blades (6) having an axial contact surface (30) configured to rest against an oppositely positioned axial contact surface (31) of the other one of said two cover discs (3, 2);

said fan blades (6) having sidewalls extending perpendicularly to said plane of said at least one cover disc (2, 3) and to said axial contact surface (30) of said fan blades (6), wherein said plane of said at least one cover disc (2, 3) and said sidewalls (19*a*, 19*b*) define first edges (22*a*, 22*b*) therebetween and wherein said sidewalls (19*a*, 19*b*) and said axial contact surfaces (30, 31) define second edges (21*a*, 21*b*) therebetween and wherein said first and second edges (21*a*, 21*b*; 22*a*, 22*b*) are rounded with a radius (R1, R2) of 0.5 to 2 mm;

wherein said two cover discs (2, 3) are configured to be non-detachably connected to one another via said axial contact surfaces (30) of said fan blades (6) and said oppositely positioned axial contact surfaces (31) by the material of said two cover discs (2, 3) providing a positive-locking connection.

2. The fan wheel according to claim 1, wherein said cover two discs (2, 3) are comprised of a sheet metal configured to be deep-drawn.

3. The fan wheel according to claim 2, wherein said material is sheet steel or sheet aluminum.

4. The fan wheel according to claim 2, wherein said at least one of said two cover discs (2, 3) has fixation noses (35) provided on said axial contact surfaces (30, 31) and formed out of said material, wherein said fixation noses (35) are configured to align said two cover discs (2, 3) with one another.

5. The fan wheel according to claim 4, wherein said fixation noses (35) are formed as rivet bolts (17) and wherein said oppositely arranged axial contact surfaces (31) have rivet openings (16), wherein said rivet bolts (17) engage said rivet openings (16) and are riveted therein to form said positive locking connection.

6. The fan wheel according to claim 1, wherein said positive locking connection of said two cover discs (2, 3) is realized by pressure joining or clinching.

7. The fan wheel according to claim 1, wherein said fan blades (6) are depressions (10) embossed out of said plane of said at least one of said two cover disc (2, 3).

8. The fan wheel according to claim 7, wherein said depressions (10) define said sidewalls (19*a*, 19*b*) of said fan blades (6) and have a bottom (8, 9) defining said axial contact surfaces (30, 31) of said fan blades (6).

9. The fan wheel according to claim 8, wherein said bottom (8, 9) has a width of 1 through 10 mm.

10. The fan wheel according to claim 9, wherein said width is 5 mm.

11. The fan wheel according to claim 8, wherein said radius of said first edges (21*a*, 21*b*) between said sidewalls (19*a*, 19*b*) and said plane of said cover discs (2,3) is an inner radius of 0.5 to 1 mm and wherein said radius of said second edges (22*a*, 22*b*) between said sidewalls (19*a*, 19*b*) and said bottoms (8, 9) is an outer radius of 0.5 to 1 mm.

12. The fan wheel according to claim 7, wherein said depressions (10) have radially positioned end faces (20*a*, 20*b*) that are rounded with a radius of 1 to 4 mm.

13. The fan wheel according to claim 12, wherein said radius is 1.5 mm.

14. The fan wheel according to claim 1, wherein said depressions (10) have a height (B/2) in the range of 1 to 10 mm.

15. The fan wheel according to claim 14, wherein said height is 5 mm.

16. The fan wheel according to claim 1, wherein one or both of said two cover discs (2, 3) have a scale embossment or a waffle embossment (25) arranged on said inner end face (12, 13).

17. The fan wheel according to claim 1, wherein said contact surfaces (30, 31) extend over an entire radial length of said fan blades (6).

18. The fan wheel according to claim 1, wherein a first part (6*a*) of said fan blades (6) is formed as a monolithic part of a first one of said two cover discs (2) and a second part (6*b*) of said fan blades (6) is formed as a monolithic part of a second one of said two cover discs (3), wherein said first and second cover discs (2,3) are formed mirror-symmetrically and identically to one another, and wherein said first and second cover discs (2,3) have identical material thickness.

* * * * *